United States Patent [19]

Peronek et al.

[11] Patent Number: 4,939,890

[45] Date of Patent: Jul. 10, 1990

[54] ANTI-ROTATION METHOD AND APPARATUS FOR BOTTLE CAPPING MACHINES

[75] Inventors: Michael H. Peronek, Chagrin Falls; Robin C. Jones, Maple Hts., both of Ohio

[73] Assignee: FCI, Inc., Cleveland, Ohio

[21] Appl. No.: 337,870

[22] Filed: Apr. 14, 1989

[51] Int. Cl.[5] ..... B67B 3/20; B67B 1/06; B65B 7/28

[52] U.S. Cl. ..... 53/486; 53/490; 53/289; 53/300; 53/317; 53/331.5

[58] Field of Search ..... 53/490, 300, 306, 314, 53/201, 317, 331.5, 486, 289

[56] References Cited

U.S. PATENT DOCUMENTS

| | | | |
|---|---|---|---|
| 1,055,796 | 3/1913 | Recht | 53/300 |
| 1,912,677 | 6/1933 | Williams | 53/300 |
| 2,987,313 | 6/1961 | Bjering et al. | 53/300 X |
| 3,432,989 | 3/1969 | Bouzereau | 53/300 X |
| 3,875,725 | 4/1975 | Carmichael | 53/300 X |
| 4,114,347 | 9/1978 | Morris et al. | 53/300 |
| 4,295,320 | 10/1981 | Willingham | 53/201 |
| 4,624,098 | 11/1986 | Trendel | 53/314 |
| 4,663,913 | 5/1987 | Trendel | 53/314 |
| 4,817,363 | 4/1989 | St. Clair | 53/300 X |

*Primary Examiner*—Horace M. Culver

*Attorney, Agent, or Firm*—Body, Vickers & Daniels

[57] ABSTRACT

Method and apparatus are disclosed for preventing rotation of bottles in a capping machine while caps are screwed onto bottle necks with capper heads which develop slight axial forces. An especially configured stationary guide member develops an off-center, mechanical force on the shoulder of the bottle which produces an anti-rotation frictional force at the bottle base while wedging the bottle into frictional engagement with an especially configured neck pocket in the capper star wheel. The guide and neck pocket are shaped to maintain the bottle in axial alignment with the capper head while the cap is started onto the bottle neck which support is removed when the cap is tightened so that the aforedescribed pocket frictional engagement can occur.

24 Claims, 6 Drawing Sheets

FIG. 6
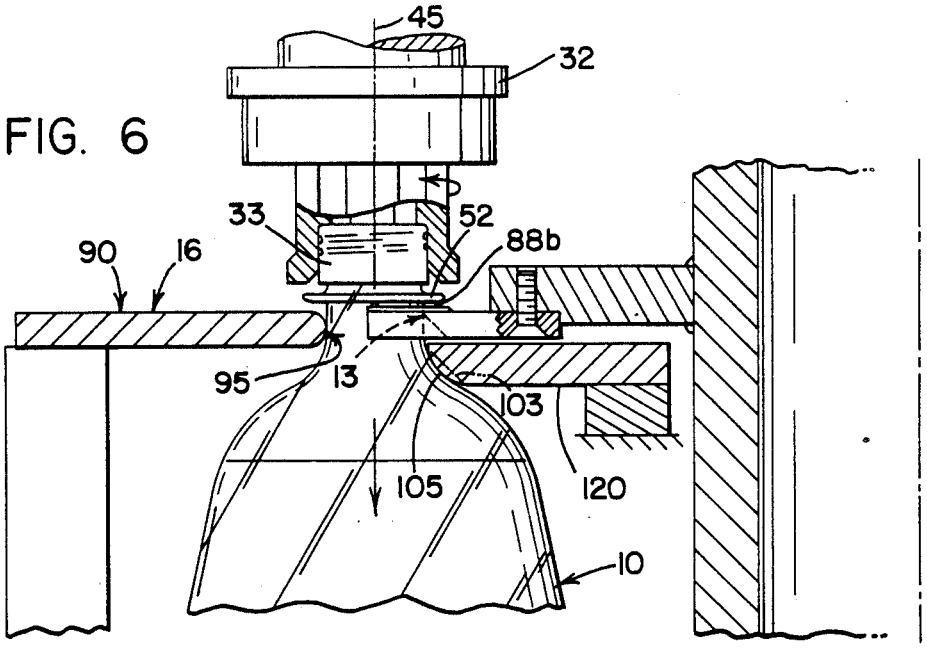
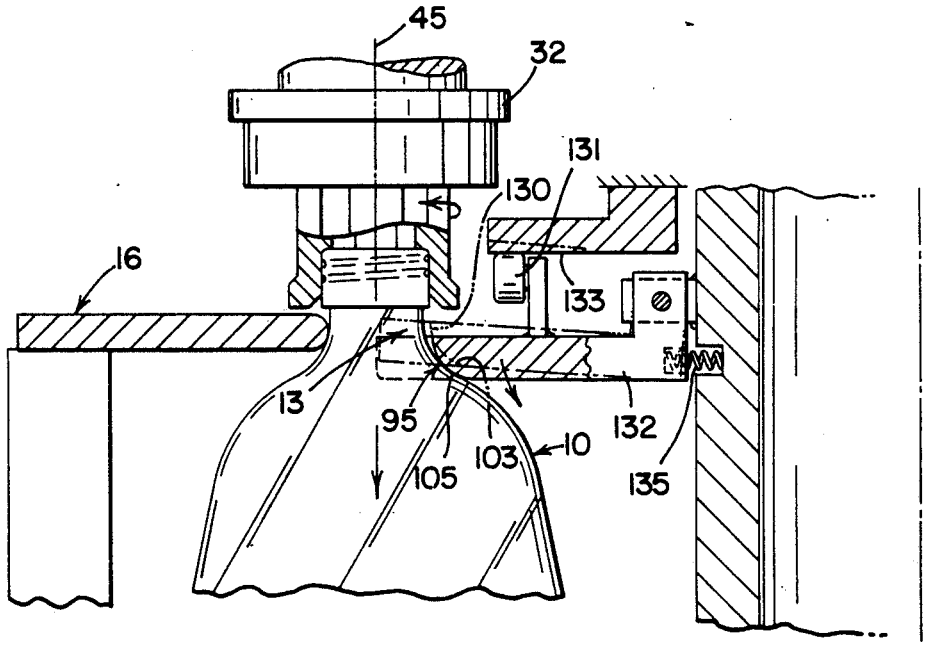
FIG. 7

ANTI-ROTATION METHOD AND APPARATUS FOR BOTTLE CAPPING MACHINES

This invention relates generally to method and apparatus for applying threaded closures to bottles and more particularly to an improvement for use in capping machines which provents rotation of the bottles while the closure is tightened.

The invention is particularly applicable to locking type threaded caps applied to plastic bottles and will be described with particular reference thereto. However, the invention has broader application and can be applied to glass bottles and any other container which require a threaded cap tightened onto a threaded neck opening.

BACKGROUND

Reference may be had to U.S. Pat. Nos. 4,624,098 and 4,295,320, incorporated by reference herein, for a description of conventional type capping machines because the details of such machines will not be described in detail in this specification. Generally speaking, the capping machine or conventional capping apparatus includes a rotatable star wheel machanism having a plurality of capper pockets adapted to receive bottles fed in an assembly line fashion thereto. Overlying the capper star wheel is a turret capper head which rotates in synchronism with the capper star wheel. Each capper head employs a clutch mechanism whereby the head is rotated and driven axially downward at a predetermined force and torque limiting value to tighten the caps onto the bottle neck. An infeed star mechanism is mated to the capper star mechanism to feed filled bottles to an entry point at the capper star wheel and an outfeed rotable star mechanism is similarly mated to the capper star mechanism to transfer the capped bottles from an exit point at the capper star wheel. A stationary rear guide extending generally between the entry and exit points is spaced radially outwardly from the capper pockets of the capper star wheel and functions to retain the bottles in the pockets as the capper star wheel rotates. This is the conventional capper mechanism employed in bottling plants today and it is the mechanism to which the present invention relates.

With respect to the cap or the closure itself, for years, the crown was the dominant closure employed and is still in use today in the beer industry. The crown closure eventually was replaced by caps or closures commonly called "roll-on" caps. This type of closure comprised a cap shell of aluminum which was inserted over the threaded neck of the container and then secured in place by rolling threads in situ into the walls of the cap shell. Capper heads which performed the rolling operation typically exerted downward forces of 500 pounds onto the neck of the bottle. This force, of course, was transmitted to the base of the bottle and thereat developed a sufficient frictional force with the capper star wheel base to prevent bottle rotation within the pocket of the capper star wheel.

The roll-on cap, in turn, has been replaced with plastic or metal locking type, threaded caps. In the beverage industry, threaded safety caps have a frangible connection at the cap base thereof which will herein be referred to as a "lock band". In the case of a metal cap, the capper heads simply crimped the lock band about the bottle neck portion beneath the lowermost thread. In the case of a plastic cap, heat was applied to the lock band of the cap after the cap was tightened onto the filled container and shrunken, in a somewhat frangible manner, to the neck of the bottle. Plastic caps with heated lock bands can be applied to either plastic or glass bottles. In the plastic cap application, the force of the capper head reduced to a downward thrust of about 50–60 pounds. This force was not sufficient to generate a sufficient frictional force at the base of the bottle to prevent the bottle from rotating in the pocket of the capper star wheel. Bottle rotation in the capper pocket prevents adequate cap tightening.

Accordingly, several different concepts have been employed to prevent bottle rotation for plastic cap applications. For example, the bottle was shaped with a wedge sidewall configuration and the transfer mechanisms between the various star wheels modified to feed the bottles into configured pockets. Additionally, a high friction material such as polystyrene was applied to the bottom of the bottle, especially for glass bottles, so as to better grip the base of the capper star wheel and enhance the frictional, anti-rotation force. Such modifications, while functional, were not acceptable. The consuming public did not accept configured bottles. Adding friction material to the bottle materially increased its cost and its effectiveness was diminished in the event the base of the capper star wheel became wet or was subjected to oil, both of which are common occurrences in the operation of a bottling plant. U.S. Pat. No. 4,624,098 to Trendel proposed an acceptable solution. In Trendel, a belt subtends a portion of the pocket to urge the bottle against the rear guide thus increasing the friction between the side of the bottle and the rear guide which, when added to the frictional force at the base of the bottle, prevented bottle rotation during tightening of the cap. This has proven acceptable in capping applications where the downward force exerted on the bottle head from the capping head is as low as 50–60 pounds.

More recently, plastic, threaded safety caps or closures have been developed which do not require the application of heat to set or position the lock band. By tapering the bottle neck beneath the lowermost thread and also tapering the edge of the lock band, the lock band simply snaps in a locking position vis-a-vis the tapered fit when the cap is tightened to a predetermined position. This position occurs when the axial downward face on the cap from the capper head is about 15–20 pounds. This low capper heat axial force makes retention of the bottle within the pocket very difficult, even with the use of very strong elastic bands in the pocket such as disclosed in the '098 patent. Accordingly, the device now in conventional use for such threaded plastic caps, at least when used on plastic bottles typically of the 1–2 liter size, is a anit-rotation device developed by Metal Box p.l.c. This device is shown in FIGS. 8 and 9 whereat a bottle 10 having a threaded neck portion 11 is received in a peripherally formed capper pocket 13 of capper star wheel 14 at a position below its threaded end. The neck 11 is conventionally forced into pocket 13 by a stationary, smooth rear guide 16. Capper pocket 13 has an arbitrarily designated forward converging surface 18 and a rearward converging surface 19. Forward converging surface 18 has backwardly facing teeth which oppose the tightening direction of rotation, indicated by arrow 20, of the capper head. Rearward converging surface 19 is smooth and acts, in conjunction with rear guide 16, as a cam surface to drive the bottle neck against the teeth of forward converging surface 18. As shown in FIGS. 8 and 9, the backwardly facing teeth of forward converging surface 18 are adjustably mounted by means of a slotted tab 21 which is precisely adjusted in relationship to the diameter of neck portion 11 to permit neck 11 to enter pocket 13 while resisting rotation of neck 11 during cap tightening.

While the device shown in FIGS. 8 and 9 is in commercial use today, the device has limitations. First, the toothed anti-rotation device is limited to plastic bottle applications in which the backwardly facing teeth can grip and permanently indent the surface without fracturing the bottle. In glass bottles, the shock loading when the backwardly facing teeth grip the neck could result in bottle fracture. Second, although the forward and rearward converging surfaces 18, 19 are designed to be easily replaced, the replacement cost for each capper pocket approaches several hundred dollars and is relatively expensive. Third and most importantly, the device is functionally limited. Not all bottles have straight neck portions underneath the threads. Many bottle designs curve or taper the neck and when this occurs, the backwardly facing teeth make detrimental point contact with the bottle neck. More significantly, the diameter of the neck portions of plastic bottles, whether tapered or straight, typically vary from the nominal dimension anywhere from +0.025 inches to −0.020 inches producing an acceptable variation in neck diameters of as much as 0.045 inches. The dimensional variation means that for some bottles, the bottles neck will be cocked or wrenched into point indentation contact with the backwardly facing teeth as the cap is tightened. This will mark or score the neck wall and such marking is, of course, aggravated if the neck tapers and is not straight. Since the plastic used to manufacture the bottle is somewhat permeable, the scoring permits the gas of a carbonated beverage within the container to more easily permeate through the plastic contributing to a "flat" beverage. More critical, though, is that the neck marking or scoring acts as a stress riser to cause an occasional bottle failure. This is unacceptable. Additionally, the bottle is aesthetically marred.

SUMMARY OF THE INVENTION

It is thus a principal object of the invention to provide method and apparatus for preventing rotation of a container, glass or plastic, in the capper pockets of a capper star wheel even though the capper heads exert only light axial forces to the base of the bottle when tightening the cap.

This object along with other features of the invention is achieved in method and apparatus which applies a threaded cap to a bottle having a threaded neck portion and a shoulder portion spaced therefrom by means of a conventional capping machine. The capping machine includes a capper star wheel with a plurality of peripherally formed capper pockets, at least one capping head for engaging a cap on a bottle positioned in a pocket at an entry position on the star wheel and tightening the cap onto the bottle with a downward force as the capper star wheel rotates the pocket to an exit position. A rear, stationary guide maintains the bottles in the pocket when the capper star wheel rotates between the entry and exit positions. In a broad sense, the invention includes a mechanically applied, downward biasing force exerted off-center on the shoulder of the bottle while the cap is tightened. The downward force does not scratch, mar or otherwise damage the bottle which can be either plastic or glass or, for that matter, a metal container while the off-center nature of the force contributes to a wedging or jamming of the bottle into the capper pocket to prevent rotation. In accordance with a more specific feature of the invention, the downward biasing force is not applied at the entry position where the neck of the bottle is uniformly supported to maintain the bottle in an aligned relationship with the capper head until the cap is initially threadingly engaged onto the neck, at which time the neck becomes vertically unsupported to permit the downward biasing force to wedge or cam the bottle into the capper pocket.

In accordance with a specific feature of the invention, the bottle is plastic and has a flange extending radially outwardly from its neck and situated a spaced distance below the bottom thread of the neck. The underside of the flange rests on the top surface of the peripheral capper pocket. At least one sharp or pointed protrusion extends from the capper surface to contact the bottle flange. The biasing downward force in addition to increasing the frictional force at the base of the bottle to resist bottle rotation, also establishes a moment or a couple which urges the bottle flange into an indenting contact with the protrustion(s) tending to "lock" the flange to the peripheral capper pocket to positively prevent rotation. While the capper head force contributes to the anti-rotation bottle force, the external, downwardly biasing force is sufficient, in itselt, to achieve the desired bottle flange-capper pocket retention or "lock up" permitting caps to be tightened with little or no downward force from the capper head while removing the aforedescribed adverse effects of the prior art which occur when the neck of the bottle is marked.

In accordance with a more specific feature of the invention, as applied to flanged plastic bottles, the rear guide which extends from at least the entry to the exit point of the capper star wheel has an edge surface and the top portion of the edge surface is adapted to maintain the bottles within the capper pockets in a conventional manner. The rear guide also has a top surface extending from the top portion of the edge surface which engages the underside of the flange so that the bottles neck is maintained by the rear guide and the capper pocket in axial alignment with the capper head. The top surface of the rear guide continues in support contact with the bottle flange for a spaced arcuate distance which is sufficient, given the speed of rotation of the capper star wheel, to equal the time needed for the capper head to initially start the threaded caps onto the bottle neck. At the end of the spaced distance, the bottom portion of the edge surface of the rear guide is curved to engage and yieldably deform the bottom shoulder portion to develop the biasing force described above. Also at the end of the spaced distance, the top surface of the rear guide is relieved so that the flange is no longer vertically supported by the top surface and the bottle neck is free to be wedged or cammed into capper pocket. It is to be appreciated that the wedging or camming action, given the dimensional relationships between capper pocket and bottle is almost imperceptible and the words are used with respect to the bottle-pocket force distribution. At the conclusion of cap tightening, the bottle springs back into shape. In glass bottle applications, the bottom edge portion of the rear guide is resiliently cammed into contact with the bottle shoulder and the neck simply wedged into the capper pocket.

It is thus an object of the invention to provide a mechanism for resisting bottle rotation in a capping machine which is operable irrespective of the axial force developed by the capper head.

It is another object of the invention to provide a mechanism for preventing bottle rotation in a capping machine which is operable on either plastic or glass bottles.

It is another object of the invention to provide an arrangement for preventing bottle rotation in a capping machine in which plastic bottles are not marked or scored in any deleterious manner.

It is still yet another object of the invention to provide an arrangement for preventing bottle rotation in a capping machine which applies safety or lock tight caps or closures, metal or plastic, to the bottle.

Still yet another object of the invention is to provide an economical, easily replaceable mechanism for preventing bottle rotation in a capping machine.

Yet another object of the invention is to provide an improved capping machine for applying threaded safety or lock tight caps to bottles.

Still another object of the invention is to provide an anti-rotation device in a bottle capping machine for preventing rotation of plastic bottles having a radially outward flange extending from the neck thereof.

Still yet another object is to provide an anti-rotation device in a bottle capping machine which does not cause failure of the bottle.

These and other objects and abvantages of the present invention will become apparent from the following description taken together with the drawings which will be described in the next section.

BRIELF DESCRIPTION OF THE DRAWINGS

The invention may take physical form in certain parts and arrangement of parts, preferred embodiments of which will be described in detail and illustrated in the accompanying drawings which form a part hereof and wherein:

FIG. 1 is a plan view of a portion of a capper star wheel mechanism employing the anti-rotation mechanism of the present invention;

FIGS. 2 and 3 are cross-sectional, elevation views taken respectively along lines 2—2 and 3—3 in FIG. 2;

FIGS. 6 and 7 are partial, cross-sectional elevation views of capper pockets illustrating alternative embodiments of the present invention;

DESCRIPTION OF THE PREFERRED EMBODIMENT

Figure 8:
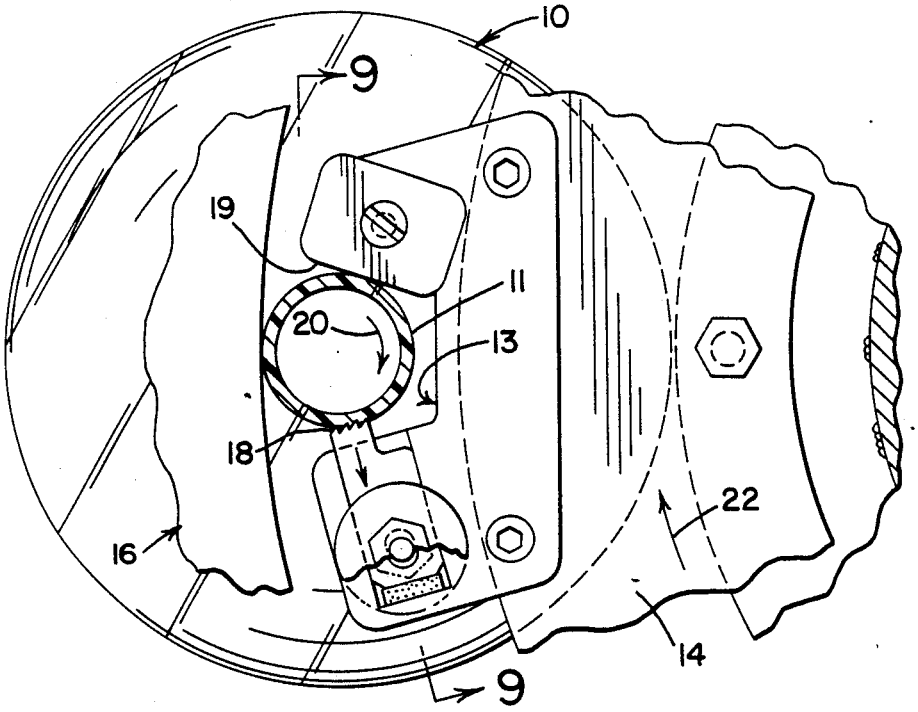
FIG. 8 (PRIOR ART)
FIG. 8 is a partial, sectioned plan view of a capper pocket of a prior art device.
Figure 9:
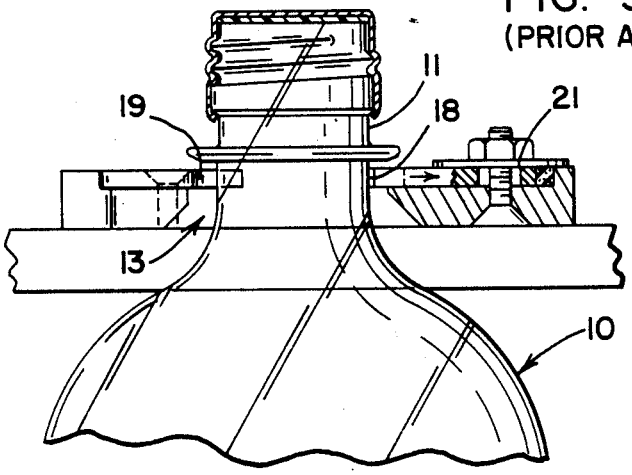
FIG. 9 (PRIOR ART)
FIG. 9 is a cross-sectional elevation view of the prior art device shown in FIG. 8 taken along line 9—9 in FIG. 8.

Referring now to the drawings wherein the showings are for the purpose of illustrating preferred embodiments of the invention only and not for the purpose of limiting same, reference may be first had to the prior art arrangement shown in FIGS. 8 and 9 and described in some detail in the background portion of the specifications. Reference numerals used in the description of the prior art device of FIGS. 8 and 9 will be used to designate like items and components in describing the present invention illustrated in FIGS. 1 through 7.

Figure 1:
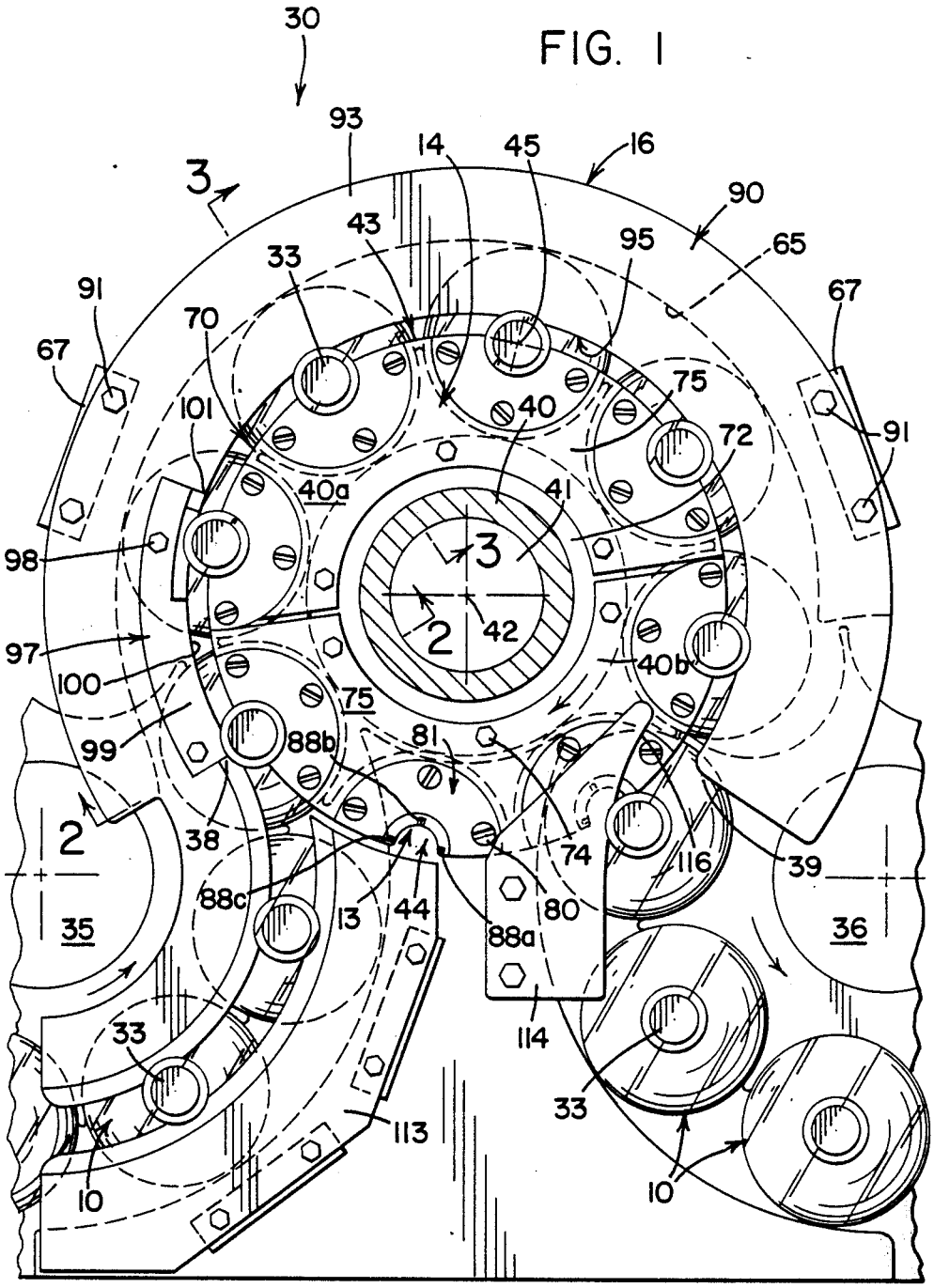
Figure 2:
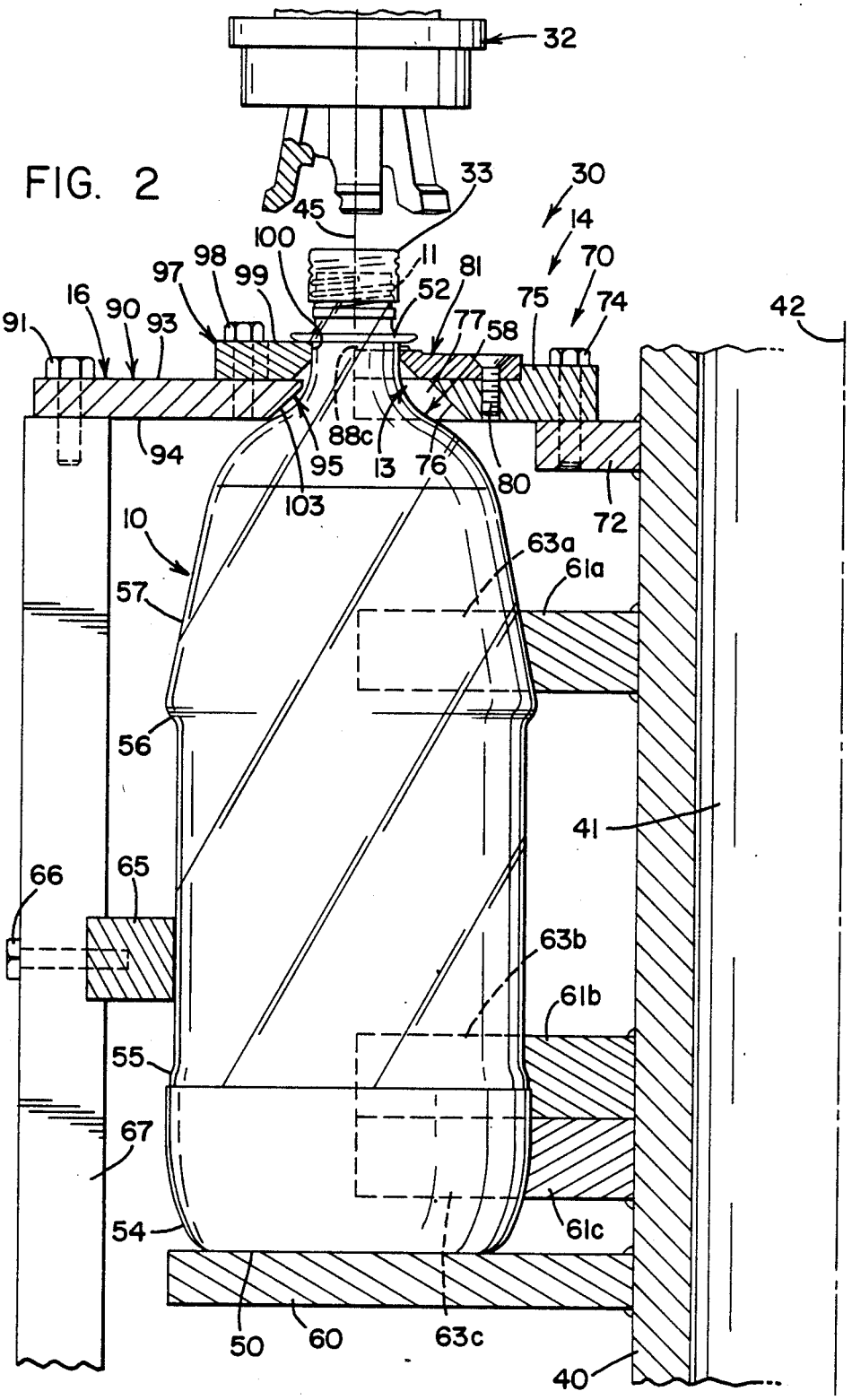
Figure 3:
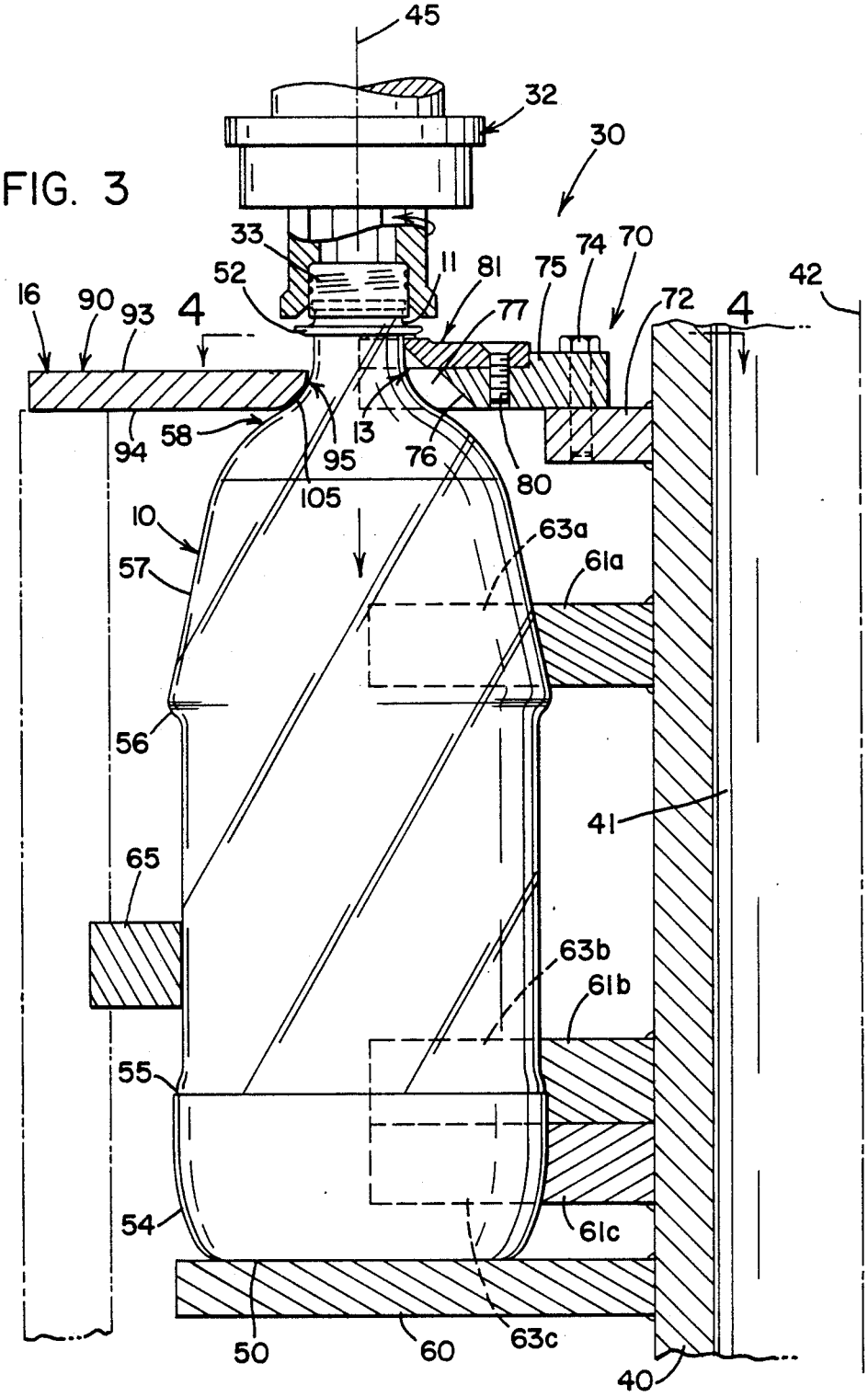

Referring now to FIGS. 1, 2 and 3, there is shown various portions of what is defined to be a capping machine 30. As noted in the Background portion of the specification, reference may be had to U.S. Pat. Nos. 4,624,098 to Trendel and 4,295,320 to Willingham, incorporated herein by reference, for a more detailed explantion of a capping machine than that set forth herein. For purposes of the specification including the terminology of the claims used herein, a capping machine 30 conventionally includes three components, namely, (a) a rotabel capper star wheel 14, (b) a rotable star turret (not shown) overlying the capper star wheel 14 and carrying a plurality of capper heads 32 for applying caps 33 to threaded neck portion 11 of bottles 10 and moving in synchronism with capper star wheel 14 and (c) finally a fixed rear guide 16 spaced radially outwardly from capper star wheel 14 for retaining bottles 10 within capper star wheel 14. The three elements, capper heads 32, capper star wheel 14 and fixed rear guide 16 are conventional. In addition, an infeed star wheel 35 is mated to capper star wheel 14 to feed bottles 10 into capper star wheel 14 and similarly an outfeed star wheel 36 is mated with capper star wheel 14 for transferring bottles 10 from capper star wheel 14 after caps 33 are tightened to bottle necks 11. For definitional purposes only, infeed and outfeed star wheels 35, 36 and the transfer ramps employed therebetween will be viewed as ancillary equipment supplied for use with a capping machine 30.

Figure 5:
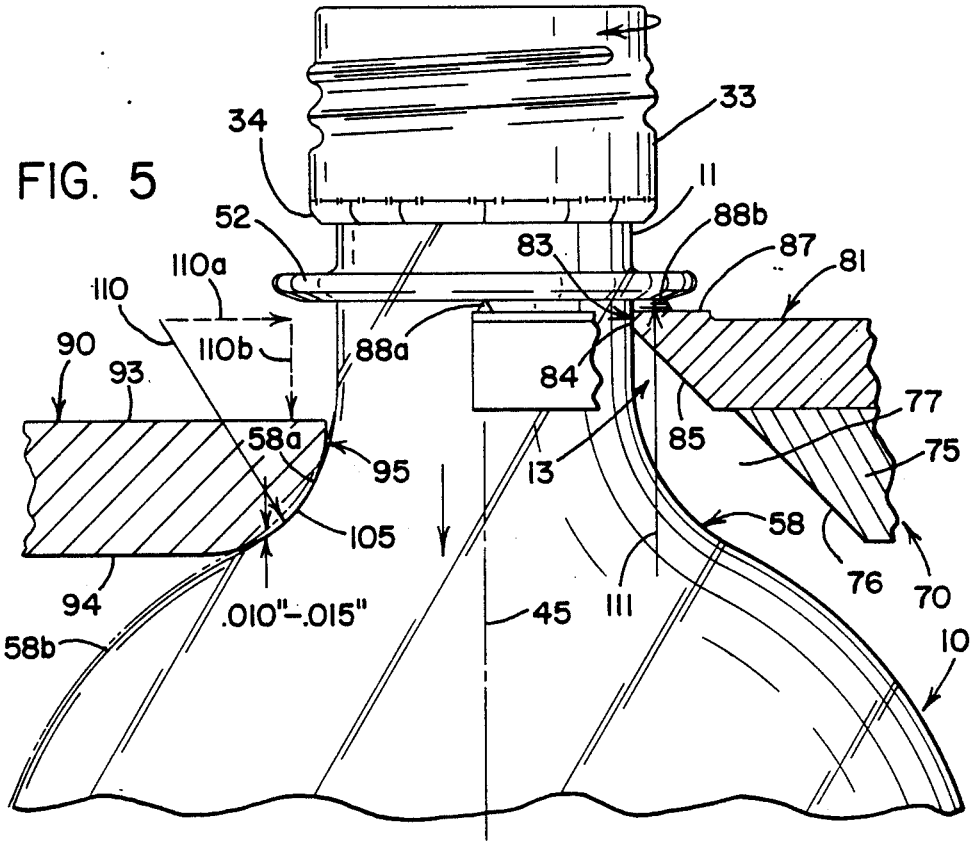
FIG. 5 is an enlarged, cross-section elevation view of the capper pocket in engagement with the neck portion of a bottle.

Insofar as the operation of turret-type bottle capping apparatus is concerned, it is sufficient to note for purposes of understanding the invention that filled bottles 10, usually with caps 33 already placed on threaded necks 11 are rotated by infeed star wheel 35 to a fixed entry point 38 on capper star wheel 14. Bottles 10 with tightened caps are rotated out of capper star wheel 14 at a fixed exit point 39 to outfeed star wheel 36 and from thence to a conveyor leading to further processing or handling equipment. Capper star wheel 14 essentially comprises a hub 40 secured to a vertically extending drive shaft (FIGS. 2 and 3). Extending radially outwardly from hub 40 is at least one star wheel 43 and formed in the periphery of star wheel 43 are a plurality of specially contoured capper pockets 44, usually semicircular in shape and of a diameter similar to that of the bottle cross-sectional diameter which it engages. For ease of machine assembly and disassembly for repair purposes, hub 40 of capper star wheel 14 is shown in FIG. 1 to be split into two equal halves **40*a*, 40*b* to permit capper star wheel repairs without dismantling the capping head turret. Infeed and outfeed star wheels 35, 36 generally have one-piece hub 40 constructions. The capping head turret (not shown) essentially comprises a hub fixed to drive shaft 41 for carrying a plurality of capper heads 32 equal in number to capper pockets 44 and extending radially outwardly from its hub so as to be axially aligned with the centers of capper pockets 44. The centerline of capper heads 32, capper pockets 44 and bottles 10 is shown coincidentally as numeral 45 in FIGS. 1 and 2. As is well known, rotation of drive shaft 41 about its axis 42 causes each capping head 32 with its associated capper pocket 44 to rotate in unison and conventional chuck-type, gear-cam mechanisms are employed to permit each capping head to rotate about pocket center 45 and move in a vertically reciprocal motion along pocket axis 45** as the entire assembly rotates about drive shaft axis 42. Specifically, vertical reciprocation of capper heads 32 is timed or coordinated with the rotation of hub 40 and the entry of bottles 10 at the fixed entry point 38 and the exit thereof at the fixed exit point 39 so that at the entry point 38 as shown in FIG. 2, the capping head 32 is vertically spaced from contact with cap 33 and then moves vertically downward into contact as shown in FIG. 3 to tighten cap 33 onto threaded neck 11 and then further vertically moves back to its FIG. 2 position after cap 33 is tightened and bottle 10 discharged at exit point 39. As thus far described, the apparatus is conventional. This also includes cap 33 which is shown in FIG. 5 to be of the aluminum type where the lock band 34 is crimped by capper head 32 under the lowermost thread in bottle neck portion 11. In the plastic cap which necessitated the invention, an outward tapered flange is formed in bottle neck portion 11 below the last neck thread and above flange 52 and an inward tapered flange is formed at the top edge of lock band 34 (not shown). As cap 33 is tightened to a particular position, the flange on lock band 34 snaps underneath the neck flange to mechanically lock cap 33 in place. The particular cap design does not form part of the invention.

Referring next to FIGS. 2, 3 and 5, bottle 10 shown in the preferred embodiment is a plastic bottle typically of 1–2 liter sizes and has a threaded neck 11 at its top end and a generally flat base 50 at its bottom end. Bottle 10 is a container generally formed of circular cross-sections which are dimensionally varied between neck 11 and base 50 to provide a desired aesthetic-volume effect. The particular plastic bottle configuration disclosed in the preferred embodiment has a generally flat, radially outwardly extending flange 52 from its neck 11 which is situated a spaced distance below the lowermost thread in neck 11. Flange 52 is generally provided in bottles of this type of configuration for carrying or handling purposes and for neck strengthening. Flang 52 is particularly useful and is utilized to perform an important feature of the present invention, but is not essential to the functioning of the invention in its broader sense. As noted, bottle 10 is comprised of generally circular cross-sections and, for purposes of definition, when adjacent cross-sentions vary or at least substantially vary in diameter, a shoulder portion is formed in bottle 10. Alternatively stated, any non-cylindrical portion of bottle 10 would be viewed as a shoulder portion. In bottle 10 of the preferred embodiment, there is a base shoulder portion 54, a pair of sidewall shoulder portions 55, 56, a tapering sidewall shoulder 57 and a neck shoulder portion 58 which takes the form of a reverse curve defined by curve 58*a* adjacent the neck and a reverse curve 58*b*. All bottles 10 have a neck shoulder portion 58 and because neck shoulder portion 58 has the smallest diameter cross-section, neck 11 is structurally stronger or more rigid than the other shoulder portions 54 through 57. Hereafter, reference to shoulder portion will mean neck shoulder portion 58 unless otherwise designated.

Referring still to FIGS. 2 and 3, capper star wheel 14 has an annular base member 60 extending radially outwardly from hub 40. Base 50 of bottle 10 rests on base member 60 and any downward force exerted on bottle 10 will develop a frictional force between member 60 and base 50 which will resist bottle rotation. Conventionally, base member 60 has a friction enhancing material applied thereto to increase the coefficient of friction with bottle base 50. Also affixed to hub 40 are annular shaped sidewall star wheels 61. Their number, spacing and position is dictated by bottle size and shape. In the preferred embodiment there are three sidewall star wheels 61*a*, 61*b* and 61*c* and formed in the periphery of each sidewall star wheel 61 is a plurality of retaining pockets 63 respectively designated as 63*a*, 63*b* and 63*c*. Each retaining pocket 63 is generally semicircular in configuration and encompasses an included angle of approximately 180°. Spaced radially outwardly from sidewall star wheels 61 is an annular sidewall rear guide 65 which is fastened by a fastener 66 to a stationary frame member 67. Sidewall rear guide 65 contacts the sidewall of bottle 10 at an area diametrically opposed to the sidewall contact established by retaining pockets 63 an functions to maintain bottle 10 in sidewall retaining pockets 63 while hub 40 rotates bottles 10 from entry point 38 to exit point 39.

Figure 4:
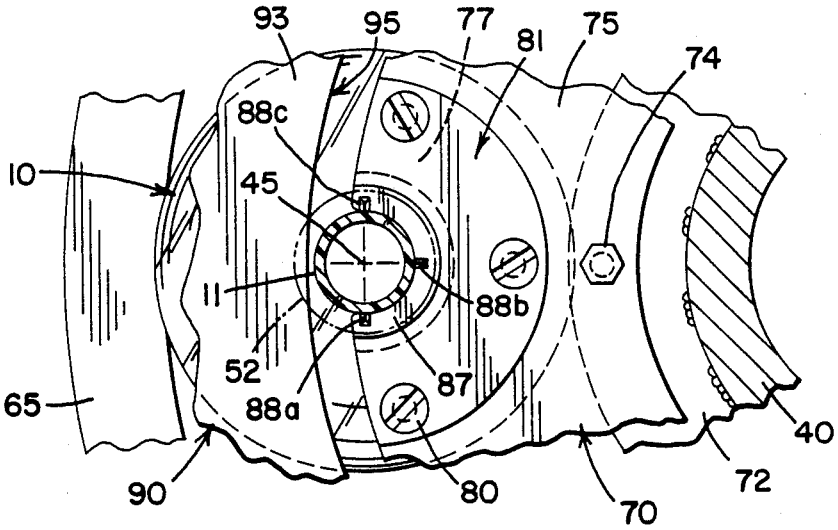
FIG. 4 is a cross-sectional plan view of the capper pocket taken along lines 4—4 of FIG. 3.

Referring now to FIGS. 1 through 5, there is provided a neck star wheel arrangement generally indicated by reference numeral 70 which comprises an assembly which forms a plurality of neck retaining pockets and for consistency in terminology will be hereafter referred to as capper pockets 13. Neck star wheel assembly 70 is shown to include an annular neck member 72 secured at its inner end to hub 40. Mounted to the top surface of annular neck member 72 as by fasteners 74 is an annular neck support plate 75 which extends radially outwardly from annular neck member 72. The outward peripheral edge surface 76 of neck support plate 75 is formed to provide a plurality of circumferentially spaced underlying neck pockets 77 of generally semi-circular configuration and dimensioned so as not to come into contact with neck 11 or shoulder portion 58 of bottle 10. Peripheral edge surface 76 at least in the area underlying neck pocket 77 is chamfered as shown in FIGS. 2, 3 and 5 to avoid any interference with bottle 10. Secured by means of fasteners 80 to each underlying neck pocket 77 is a replaceable neck pocket insert 81. As best shown in FIG. 5, insert 81 has an edge surface 83 which is vertically straight at its top portion for about ⅛ inch as at 84 and chamfered towards its bottom as at 85. Nominally, vertically straight surface 84 is spaced radially inwardly from bottle neck 11 approximately 1/16 inch. Vertically straight surface 84, for definitional purposes, defines capper pocket 13. Vertically straight surface 84 intersects with a top surface 87 of insert 81. Extending from top surface 87 is at least one sharp protrusion 88 as best shown in FIGS. 4 and 5. The dimensioning of neck star wheel arrangement 70 is such that when bottle base 50 is resting on base member 60, sharp protrusion 88 contacts the underside of flange 52. As noted and in theory, one protrusion 88 is required, but in practice, and preferably three protrusions 88*a*, 88*b* and 88*c* are employed and each protrusion is spaced 90° from the other so that the protrusions encompass an included angle of 180°. Preferably, protrusions 88, as shown in FIG. 5, are configured to resemble knife edges extending radially outwardly a slight distance from vertically straight surface 84. Insert 81 is a hardened steel and protrusions 88 may have special hardening treatments such as flame hardening that increase their wear characteristics. It should be noted that the contact between protrusions 88 and the underside of flange 52 cannot harm or damage bottle 10.

Referring next to FIGS. 1, 2, 3 and 5, fixed rear guide 16 includes an annular rear neck guide 90 secured in a stationary manner by fasteners 91 to frame member 67. Rear neck guide 90 has a top surface 93, a bottom surface 94 and an especially configured, radially inward edge surface 95 adapted to contact shoulder portion 58 in a manner to be described. As best shown in FIGS. 1 and 2, an annular neck block 97 is secured by fasteners 98 to top surface 93 of neck guide 90. Neck block 97 has a top surface 99 which is adapted to be, as shown in FIG. 2, in contact with the underside surface of flange 52. Neck block 97 also has a radially inward edge surface, a portion of which is shown as vertically straight as at 100 and which is spaced approximately 1/16 inch away from the nominal dimension of bottle neck 11. Again, for consistent terminology usage, vertical straight edge surface 100 could be viewed as functionally equivalent to fixed rear guide 16 of the prior art shown in FIGS. 8 and 9 and that its function, to retain bottle 10 in capper pocket 13 is equivalent to the prior art. Refering to FIG. 1, neck block 97 extends from entry point 38 of capper star wheel 14 a fixed arcuate distance or spaced distance and terminates at a transition point designated as 101. The distance from fixed entry point 38 to neck block transition point 101 corresponding to the time it takes for capping head 32 to move vertically downward, engage cap 33 and turn cap 33 into threaded engagement with neck 11, without tightening cap 33, while capper star wheel 14 rotates through the spaced distance. During this time period, the underside of flange 52 is completely supported by neck block 97 and protrusions 88 so that bottle neck 11 is maintained in precise vertical alignment with capping head 32 to positively insure that caps 33 are started on the threads of neck 11 without any possibility of cross-threading or stripping.

Referring next to FIGS. 2 and 3, edge surface 95 of rear neck guide 90 one configuration between entry point 38 and transition point 101 and another configuration between transition point 101 and exit point 39. As shown in FIG. 2, edge surface 95 is tapered or chamfered as at 103 between points 38 and 101 to avoid any contact with bottle shoulder portion 58 whereas chamfered portion 103 of edge surface 95 is curved as at 105 between points 101 and 39. In point of fact, the transition between chamfered surface 103 and curved surface 105 may be gradual (not shown) to avoid a shock loading on bottle 10. The effect of curved surface 105 is best shown in FIG. 5. Specifically, the radius of curvature of arcuate surface 105 is determined relative to the dimension of shoulder portion 58 to establish an interference fit of approximately 0.010 inches to 0.015 inches for plastic bottles 10. That is because rear neck guide 90 is fixed, shoulder portion 58 will be resiliently distorted by the interference established, i.e. preferably 0.010–0.015 inches for a one liter bottle and, this distrotion, is occurring in the most rigid part of plastic bottle 10. Specifically, the distortion is occurring principally over the neck radius **58*a* of shoulder portion 58. The force developed by rear guide arcuate surface 105 on bottle 10 is significant and larger than that which would otherwise by established if rear neck guide were positioned at some larger diameter shoulder portion of bottle 10. Thus, while in theory the invention will function by distorting any shoulder portion, in practice distortion of neck shoulder portion 58** is preferred.

As described thus far and with reference to the plastic bottle illustrated in FIGS. 1 through 5, it should be noted that the invention provides a positive, circumferential engagement of the underside of flange 52 to precisely support or maintain the appropriate attitude of bottle 10 relative to capper head 32 to permit caps 33 to be initially started or threaded onto bottle 10. At a spaced distance, the support is removed and arcuate surface 105 is cammed into shoulder portion 58 of bottle 10. As shown in FIG. 5, guide force 110 is exerted onto shoulder portion 58 by arcuate surface 105 and guide force 110 in turn has a vertical component **110*b* and a horizontal component 110*a*. Horizontal component 110*a* serves to wedge bottle 10″ into capper pockets 13 as well as retaining pockets 63 and friction between bottle 10 and those surfaces tends to resist bottle rotation as a result of cap tightening. In addition, vertical force 110*b* is also transmitted to bottle base 50 and base member 60 and this force also establishes frictional resistance to bottle rotation. In fact, force component 110*b* adds to the axial force exerted from capper head 32 and in theory can be predetermined to establish a sufficient frictional force to begin approximating some of the prior art axial forces whereat bottle rotation was not of a significant concern. In point of fact, this is precisely what is done in glass bottle applications since the shoulder portion 58 of a glass bottle does not deflect. With respect to the preferred embodiment of the plastic bottle, vertical downward component 110*b* is laterally offset from vertical bottle centerline 45 and this produces a couple or a moment with a reaction force 111 at middle protrusion 88*b*. The moment or couple forces flange 52 to then pivot about protrusions 88*a* and 88*c* which in effect indents or lock themselves into the underside of flange 52 and this locking, marking or indenting of flange 52 has no adverse affect on bottle 10 aesthetically or otherwise and provides almost a pin connection between capper pocket 13 and bottle 10 to positively resist any rotation of bottle 10 within capper pocket 13**.

At this point, it should be clarified that the force analysis will produce movement or seating of the bottle into capper pocket 13 and retaining pockets 63 but this movement is very slight, almost imperceptible to the eye, because of the dimensions of the parts. Further, the movement does not interfere with the tightening of cap 33 by capper head 32 which, importantly, have already threadly engaged cap 33 with neck 11 before the offset or off center force 110 is applied. At the same time, however, forcing bottle 10 into capper pocket 13 and retaining pockets 63 develops a contact force between pocket 13 and bottle 10 which produces a frictional force at such surfaces resisting bottle rotation and the frictional pocket-bottle force is applied regardless of the axial force exerted on the bottle by capper head 32. Because of the frictional pocket contact forces, any wear of protrusions 88 will not significantly or adversely affect the anti-rotation characteristics of the invention.

Completing the description of the preferred embodiment and with reference to FIG. 1, it is noted that infeed transfer guide 113 and an outfeed transfer guide 114 are provided to support bottle neck 11 at the underside of flange 52 as bottles 10 are transferred into and out of capper star wheel 14. The bottle flange contacting surfaces of transfer guides 113, 114 can be optimally vertically ramped or cammed (not shown) to ease the transition of bottles into and out of the capper star wheel which is occurring at a high transfer rate. For example, outfeed transfer guide 114 could be ramped at 116 to insure separation of protrusions **88*a*–88*c* from the underside of flange 52 an infeed transfer guide could be similarly ramped to insure that protrusions 88*a*, 88*b* do not interfere with flange 52 as bottles 10 are transferred into capper pockets 13**.

FIG. 6 discloses a modification to the preferred embodiment disclosed in FIGS. 1 through 5 for use with a plastic bottle having a flange 52 and reference numerals used in FIG. 6, for consistency, will indicate the same parts and components identified in FIGS. 1 through 5 where applicable. In FIG. 6, rear neck guide 90 employs a neck block (not shown) in the same fashion and for the same purposes as that previously discussed. However, the radially inward edge surface 95 is rounded in a conventional manner and essentially functions to keep bottle 10 in capper pocket 13. A separate fixed and stationary guide member 120 is provided on the same side of bottle 10 as capper pocket 13. Stationary guide 120 has the same edge surface 95 configuration as that disclosed for annular rear neck guide 90 in the preferred embodiment illustrated in FIGS. 1 through 5 (chamfered and arcuate surfaces 103, 105 respectively). However, because of the orientation of guide member 120 the downward force produced by the interference fit will tend to pivot bottle 10 about protrusions 88*a*, 88*c* and pin, indent or lock the underside surface of flange 52 with protrusion 88*b*. The modification is disclosed to simply indicate that the off-center, downward force can be applied over an area of bottle 10 underlying capper pockets 13 as well as being diametrically opposed to capper pockets 13.

The alternative embodiment disclosed in FIG. 7 is for use with a glass bottle 10 and, for consistency, reference numerals in FIG. 7 will designate the same parts and components as discussed previously. Glass bottle 10 does not have a flange 52. Thus, fixed rear guide 16 is conventional. However, capper pocket 13 has its edge surface 95 shaped similar to that disclosed in the preferred embodiment and has chamfered relief surface 103 and arcuate surface 105. Also, edge surface 95 has a vertically straight portion 130 at its top portion which functions in a conventional manner to maintain the proper vertical alignment of bottle 10 relative to capper head 32 between entry point 38 and transition point 101. After transition point 101, capper pocket 13 can be shifted into the particular positions shown in FIG. 7 by means of a roller 131 mounted on a spring biased lever arm 132 contacting an appropriately cammed surface 133. The downward force developed by arcuate surface 105 is thus resiliently achieved by compression of spring 135 vis-a-vis cammed displacement of lever arm 132. This modification is disclosed to show that the invention can be applied to a glass bottle. The configuration disclosed in FIG. 7, as in the plastic bottle application, centers glass bottle 10 in capper pocket 13 (without any bottle flange) until the cap is started onto the threads and then exerts a downward shoulder force on bottle 10 by external spring means.

The invention has been described with reference to preferred and alternative embodiments, and further modifications and alterations will occur to others upon reading and understanding the specifications. For example, the invention was necessitated by a plastic safety or lock tight cap 33. However, the invention can be applied to any type of a cap to be screwed onto the neck of a bottle by a capper head of the type described. Further, the invention has been described with reference to a downward force applied to a shoulder portion of the bottle adjacent the neck portion. The downward force could be applied to any portion of the bottle or container. It is our intention to include all such modifications and alterations insofar as they come within the scope of the present invention.

It is thus the essence of our invention to provide a mechanism which exerts a precisely positioned, off-center downward force to a bottle or a container which functions to jam or force the bottle or container into a capper star wheel pocket to prevent rotation of the bottle or container during the cap tightening process.

Having thus defined the invention, we claim:

1. A method for applying a cap to a bottle having a threaded neck portion and a shoulder portion removed therefrom by means of a capping machine, said capping machine including a capper star wheel having a plurality of peripherally formed capper pockets and a retaining pocket underlying each capper pocket, at least one capper head for engaging a cap on a bottle positioned in a pocket at an entry position on said star wheel and tightening said cap onto said bottle with a downward force as said capping star wheel rotates said pocket to an exit position and a rear, stationary guide maintaining said bottle in said pocket when said star wheel rotates said pockets between said entry and exit positions, said method comprising the steps of circumferentially supporting said neck portion to position said bottle in axial alignment with said capping head for a partial rotation of said capper star wheel until said capping head initially threadly engages said cap with said neck;

removing at the completion of said partial rotation at least a portion of said support from said neck so that said bottle is no longer positioned by said neck and exerting an off-center, downwardly directed biasing force on said shoulder portion to wedge said bottle into engagement with said capper and retaining pockets while increasing the force at the base of the bottle with said capper star wheel whereby said bottle is prevented from rotating while said cap is tightened by said capping head.

2. The method of claim 1 wherein said bottle is plastic and said threaded neck portion has a radially-outwardly extending flange below the threads and above said shoulder portion, and said supporting step includes supporting said flange at at least one point adjacent to said capper pocket and one point adjacent to said rear guide and removed from said pocket, and said removing step includes removing said support adjacent to said rear guide when said cap has been initially threaded onto said bottle and prior to tightening thereof.

3. The method of claim 2 wherein said downward force is exerted by said rear guide and is sufficient to physically distort said shoulder portion in a resilient manner, and the axial thrust of said capping head is about 15 to 20 pounds.

4. A method for applying a cap to a plastic bottle having a threaded neck portion and a shoulder portion removed therefrom by means of a capping machine, said capping machine having a capper star wheel with a plurality of peripherally formed capper pockets, at least one capper head for engaging a cap on a bottle positioned in a pocket at an entry position on said star wheel and tightening said cap onto said bottle with a downward force as said capping star wheel rotates said pocket to an exit position and a rear, stationary guide maintaining said bottle in said pocket when said star wheel rotates said pockets between said entry and exit positions, said method comprising the steps of supporting said neck portion in axial alignment with said capping head at least until said capping head initially threadly engages said cap with said neck and thereafter;

exerting an off-center biasing force on said shoulder portion directed downwardly towards the base of bottle whereat frictional engagement with the base of said capper star wheel resists rotation while simultaneously wedging said bottle into frictional engagement with said pocket whereby said bottle is prevented from rotating while said cap is tightened by said capping head, said downward force being sufficient to physically distort said shoulder portion in a resilient manner, and each capper pocket has at least one sharpened protrusion extending adjacent the pocket opening and contacting the underside of said flange, said biasing force wedging said flange into said protrusion to pin said flange to said capper pocket whereby said bottle is prevented from rotating within said capper pocket independently of the axial force exerted from said capper head.

5. The method of claim 4 wherein said capping machine further includes an outfeed star wheel having a transfer ramp adjacent said flange and said capper star wheel, said method further including the step of contacting said flange with said transfer ramp and raising each bottle a distance equal to that of said protrusion as said bottle is transferred to said outfeed star wheel from said capper star wheel to assure positive transfer from said capper star wheel after each bottle has been capped.

6. The method of claim 5 wherein said capping machine further includes an outfeed star wheel having a transfer ramp adjacent said flange and said capper star wheel, said method further including step of contacting said flange with said transfer ramp and gradually raising each bottle a distance equal to that of said protrusion as said bottle is transferred to said outfeed star wheel from said capper star wheel to assure positive transfer from said capper star wheel after said bottle has been capped.

7. A method for applying a cap to a plastic bottle having a threaded neck portion, a radially outwardly extending flange protruding from said neck portion, and a shoulder portion removed therefrom by means of a capping machine, said capping machine having a capper star wheel with a plurality of peripherally formed capper pockets, each of said pockets having at least one sharp protrusion in contact with said flange, at least one capper head for engaging a cap on a bottle positioned in a pocket at an entry position on said star wheel and tightening said cap onto said bottle with a downward force as said capping star wheel rotates said pocket to an exit position and a rear, stationary guide maintaining said bottle in said pocket when said star wheel rotates said pockets between said entry and exit positions, said method comprising the steps of exerting an off-center mechanically applied downward force on said shoulder portion during the time said cap is tightened and after said closure cap is initially engaged in threaded relationship with said neck portion;

said downward force sufficient to resiliently deform said shoulder portion and pivot said bottle into indenting contact between said flange and said protrusion whereby said bottle is prevented from rotating within said capper pocket despite low axial forces from said capper head.

8. A capping machine for applying threaded caps to threaded necks of containers having generally circular cross-sections defining at least one shoulder portion of said container, said machine comprising:

(a) a rotatable turret carrying a plurality of capper heads for applying said caps to said necks;

(b) rotatable capper star wheel means having a plurality of peripherally formed capper pockets and a retainer pocket underlying each capper pocket for receiving and moving said containers in synchronism with said plurality of capper heads and a base adapted to be in contact with the bottom of said container;

(c) capper guide means radially spaced from said capper star wheel means for engaging at least one circular cross-section of said container at a position diametrically opposite said pockets to retain containers in said capper and retaining pockets; said capper guide means including neck support means acting in cooperation with aid capper pockets for initially supporting said containers in precise relationship to said capper head to permit said caps to be initially threaded onto said neck; and (d) biasing means affixed to one of said capper guide means and said capper star wheel means for resiliently engaging a portion of said shoulder portion of said container to exert an offset downward force on the base of said container and wedge said container into said capper and retaining pockets to prevent rotational movement of said container within said pockets when said capper heads tighten said threaded caps to said necks.

9. The capping machine of claim 8 wherein said star wheel means has an entry end where containers are received and an exit end where capped containers are discharged and a plurality of capper pockets for receiving said neck portions of said containers; said neck support means includes a rear guide extending approximately from said entry end to said exit end and adapted to be in contact with said necks adjacent said entry end while being out of contact with said necks at a spaced distance from said entry end whereby said containers are maintained by said capper pockets and said rear guide in a precise axial alignment with said capper heads to permit said caps to be initially threaded to said necks at said entry end.

10. The capping machine of claim 9 wherein said rear guide contacts said shoulder of said container at said spaced distance whereby said container is forced down against its base while wedged in said capper and retaining pockets to prevent rotation thereof when said cap is tightened.

11. The capping machine of claim 10 wherein said container has a radially-outwardly extending flange below said threads, said rear guide has an arcuate edge surface and a top surface extending therefrom, a top portion of said edge surface adjacent the underside of said flange and adapted in cooperation with said capper pocket to support said bottles for initial cap application, and a bottom portion of said edge surface removed from said top edge portion adapted to be in contact with said shoulder at said spaced distance for wedging said container into said capper and retaining pockets and out of contact with said shoulder at said entry position.

12. The capping machine of claim 8 wherein said container are glass bottles, said biasing means affixed to said capper guide means, said capper guide means including a rear guide extending from the entry end of said capper star wheel means where bottles are received and to an exit end where bottles are discharged from said capper star wheel means, said biasing means further including a cam and resilient spring beams for camming said rear guide as a lever arm into contact with said shoulder portion of said bottles.

13. The capping machine of claim 8 wherein said capper guide means includes at least first and second vertically spaced rear guides, said first guide positioned adjacent neck, said biasing means affixed to said capper guide means and effective to exert said downward, offset force against said shoulder portion underlying said capper pocket sufficient to wedge said bottle away from said pockets into said first and second rear guides while simultaneously forcing said container bottom into contact with said base to prevent rotation of said bottle during cap tightening.

14. A capping machine for applying threaded caps to threaded necks of containers having generally circular cross-sections defining at least one shoulder portion of said container, said containers are plastic bottles having a radially outwardly extending flange situated at the neck of said bottle and spaced from said threaded opening said machine comprising:

(a) a rotatable turret carrying a plurality of capper heads for applying said caps to said necks;

(b) rotatable capper star wheel means having a plurality of peripherally formed capper pockets formed therein for receiving and moving said containers in synchronism with said plurality of capper heads, said star wheel means has an entry end where containers are received and an exit end where capped containers are discharged and said plurality of capper pockets receive said neck portions of said containers;

(c) capper guide means spaced from said capper star wheel means for engaging at least one circular cross-section of said container to retain containers in said capper pockets, said capper guide means includes a rear guide extending approximately from said entry end to said exit end and adapted to be in contact with said necks adjacent said entry end while being out of contact with said necks at a spaced distance from said entry end whereby said containers are maintained by said capper pockets and said rear guide in a precise axial alignment with said capper heads to permit said caps to be initially threaded to said necks at said entry end, said rear guide adapted to contact said shoulder of said container at said space distance whereby said container is forced down against its base while wedged in said pocket to prevent rotation thereof when said cap is tightened, said rear guide further having an edge surface and a top surface extending therefrom, a top portion of said edge surface adjacent said top surface and adapted to maintain said bottles in said pocket, and a bottom portion of said edge surface removed from said top edge portion adapted to be in contact with said shoulder at said space distance and out of contact with said shoulder at said entry position;

(d) biasing means including said rear guide for resiliently engaging a portion of said shoulder portion of said container to prevent rotational movement of said container within said capper pockets while said capper heads tighten said threaded caps to said necks, and said pockets adapted to engage said bottle neck adjacent the underside of said flange, at least one sharp protrusion extending from each capper pocket and adapted to contact the underside of said flange when said bottle is positioned within said pocket, said biasing means effective to wedge said flange against said protrusion whereby said protrusion grips said flange in an indenting manner to prevent rotation of said bottle within said pocket.

15. A capping machine for applying threaded caps to threaded necks of plastic bottles having generally circular cross-sections defining at least one shoulder portion of said bottle and a radially outwardly extending flange situated at the neck of said bottle and spaced away from said threaded opening thereof, said machine comprising:

(a) a rotatable turret carrying a plurality of capper heads for applying said caps to said necks;

(b) rotatable capper star wheel means having a plurality of peripherally formed capper pockets formed therein for receiving and moving said containers in synchronism with said plurality of capper heads, (c) capper guide means spaced from said capper star wheel means for engaging at least one circular cross-section of said container to retain containers in said capper pockets, (d) biasing means affixed to one of said capper guide means and said capper star wheel means for resiliently engaging a portion of said shoulder portion of said container to prevent rotational movement of said container within said capper pockets while said capper heads tighten said threaded caps to said necks, and said pockets adapted to engage said bottle neck adjacent the underside of said flange, at least one sharp protrusion extending from each capper pocket and adapted to contact the underside of said flange when said bottle is positioned within said pocket, said biasing means effective to wedge said flange against said protrusion whereby said protrusion grips said flange in an indenting manner to prevent rotation of said bottle within said pocket.

16. The capping machine of claim 15 wherein said star wheel means has an entry end where containers are received and an exit end where capped containers are discharged and a plurality of capper pockets for receiving said neck portions of said containers; said capper guide means includes a rear guide extending approximately from said entry end to said exit end and adapted to be in contact with said necks adjacent said entry end while being out of contact with said necks at a spaced distance from said entry end whereby said containers are maintained by said capper pockets and said rear guide in a precise axial alignment with said capper heads to permit said caps to be initially threaded to said necks at said entry end.

17. The capping machine of claim 16 wherein said biasing means includes said rear guide contacting said shoulder portion of each bottle at said spaced distance diametrically opposite said pockets.

18. The capping machine of claim 16 wherein said biasing means contacts said shoulder portion on the same side of said bottle as said pocket.

19. An apparatus for applying threaded caps to threaded necks of plastic bottles having a radially outwardly extending flange situated at the neck of said bottles and spaced from said threaded opening and further having generally circular cross-sections, one of which comprises a shoulder situated beneath said neck, said apparatus including rotatable capper star wheel means having a plurality of peripherally formed capper pockets formed therein for receiving and moving said containers from an entry point to an exit point, rotatable turret capper head means for screwing caps onto said containers in synchronism with said capper star wheel means, a rear guide radially spaced from said capper star wheel means for engaging a portion of at least one of said circular cross-sections for retaining said container within said pockets between said entry and exit points during rotations of said capper star wheel means, the improvement comprising:

biasing means affixed to one of said rear guide and said star wheel means for resiliently engaging said shoulder portion of said container to prevent rotations movement of said container within said capper pockets while said capper head means tighten said cap to said bottle;

said rear guide member being dimensioned to contact said neck of said container for a spaced distance extending from said entry point and to be out of contact with said neck portion for a distance extending from said spaced distance to said exit point whereby said containers are maintained in alignment with said capping head means to permit initial threaded engagement of said caps with said neck, and said biasing means is actuated only after said capper star means rotates a container said spaced distance; and said pockets having at least one sharp protrusion extending therefrom and adapted to contact the underside of said flange when said bottle is positioned within said pocket, said biasing means effective to wedge said flange against said protrusion whereby said protrusion grip said flange in an indenting manner to prevent rotation of said bottle within said pocket.

20. The apparatus of claim 19 wherein said biasing means includes said rear guide contacting said shoulder portion of each bottle diametrically opposite said pocket.

21. The apparatus of claim 19 wherein said biasing means contacts said shoulder portion on the same side of said bottle as said pocket.

22. The apparatus of claim 19 wherein said rear guide has an edge surface and a top surface extending therefrom, said edge surface further having a top edge portion adjacent said top surface and a bottom edge portion, said top surface adapted to contact said underside of said flange at said entry point and maintain said contact for a spaced distance along said rear guide, and said top surface adapted to disengage contact with said flange as said containers move relative said rear guide from said spaced distance to said exit point whereby said protrusions and said top surfaces maintain said container axially aligned with said capper head means to permit said caps to be initially threaded onto said necks.

23. The apparatus of claim 22 wherein said lower edge portion is adapted to be out of contact with said shoulder portion from said entry point through said spaced distance and in contact with said shoulder portion at the end of said spaced distance and to said exit point whereby said container can be wedged into said pocket while said cap is tightened onto said neck.

24. The apparatus of claim 23 further including a transfer ramp at said exit point adapted to engage said underside of said flange, said transfer ramp having a cam surface for lifting said flange from said protrusions.

* * * * *

UNITED STATES PATENT AND TRADEMARK OFFICE

CERTIFICATE OF CORRECTION

PATENT NO. : 4,939,890

DATED : July 10, 1990

INVENTOR(S) : Michael H. Peronek, Robin C. Jones

It is certified that error appears in the above-identified patent and that said Letters Patent is hereby corrected as shown below:

Column 1, line 8, "provents" should read--prevents---; line 25, "machanism" should read--mechanism--. Column 2, line 6, after "head" insert--was--; line 46, "face" should read--force--; line 53, "a anit-rotation" should read "an anti-rotation--. Column 4, line 27, "itselt" should read--itself--; line 42, "bottles" should read--bottle--. Column 5, line 28, "abvantages" should read--advantages--; line 33, "BRIELF" should read--BRIEF--; line 43, "FIG. 2" should read--FIG. 1--. Column 6, line 13, "rotable" should read--rotatable--; line 43, after "shaft" insert--41--. Column 7, line 38, "Flang" should read--Flange--; line 44, "cross-sentions" should read--cross-sections--. Column 8, line 15, "an" should read--and--; line 53, delete "and". Column 9, line 17, "Refering" should read--Referring--; line 52, "distrotion" should read--distortion--. Column 10, line 8, "10""should read-- 10--; line 67, "an" should read--and--. Column 15, lines 51 and 61, "space" should read--spaced--. Claim 19, line 41, "grip" should read--grips--.

Signed and Sealed this

Twenty-first Day of January, 1992

*Attest:*

HARRY F. MANBECK, JR.

*Attesting Officer*

*Commissioner of Patents and Trademarks*